United States Patent [19]

Hammond et al.

[11] 4,317,066

[45] Feb. 23, 1982

[54] GASEOUS DISCHARGE LAMP HAVING NOVEL ELECTRODE MOUNTINGS

[75] Inventors: Thomas J. Hammond, Penfield; Karl A. Northrup, Rochester, both of N.Y.

[73] Assignee: Xerox Corporation, Stamford, Conn.

[21] Appl. No.: 118,337

[22] Filed: Feb. 4, 1980

[51] Int. Cl.[3] ..... H01J 61/36

[52] U.S. Cl. ..... 313/493; 313/488; 313/220; 313/274; 313/318

[58] Field of Search ..... 313/485, 488, 491, 493, 313/217, 274, 287, 318, 331, 220; 339/50 R, 145 D

[56] References Cited

U.S. PATENT DOCUMENTS

| | | | |
|---|---|---|---|
| 2,448,937 | 9/1948 | Walter | 313/318 X |
| 3,225,241 | 12/1965 | Spencer et al. | 313/488 |
| 3,275,872 | 9/1966 | Chernin et al. | 313/488 |
| 3,546,519 | 12/1970 | Hashimoto et al. | 313/220 X |
| 3,717,781 | 2/1973 | Sadoski et al. | 313/113 X |
| 3,767,956 | 10/1973 | Bauer | 313/485 |
| 3,904,916 | 9/1975 | Emidy et al. | 313/493 |
| 4,155,758 | 5/1979 | Evans et al. | 313/221 X |

FOREIGN PATENT DOCUMENTS

| | | | |
|---|---|---|---|
| 432459 | 7/1935 | United Kingdom | 339/50 R |

*Primary Examiner*—Eugene R. La Roche

[57] ABSTRACT

A tubular arc low pressure discharge lamp is disclosed which has its end electrodes connected through the lamp envelope then to the tube pins. This permits the electrodes to be physically located closer to the lamp ends and decrease end illumination falloff.

7 Claims, 3 Drawing Figures

GASEOUS DISCHARGE LAMP HAVING NOVEL ELECTRODE MOUNTINGS

BACKGROUND OF THE INVENTION

This invention relates to arc discharge lamps and, more particularly, to novel electrode mounting configurations which reduce the required length of the lamp envelope.

Tubular arc discharge lamps, such as conventional fluorescent lamps, project light upon a surface in a relatively uniform manner except for a gradual decrease in illumination near the ends. This end falloff is ordinarily not a problem when the lamp is used for general purpose lighting. In certain applications, however, such as use as the exposure source in a photocopying machine, the light falloff is compensated for in some manner to obtain relatively uniform illumination of a document to be copied. Various ways of providing for this compensation are known to the art: U.S. Pat. Nos. 3,225,241 and 3,717,781 are representative of the so-called aperture fluorescent lamps which disclose ways of changing the properties of the coatings near the ends of the lamp. In the xerographic art, it is more usual to shape the output light profile of the illumination lamp by interposing a so-called butterfly slit in the optical path between the lamp and the document, the slit shape serving to allow increased illumination at the ends of the document. Whether the compensation is within the lamp itself, or to the light output, there is an inherent penalty in the length of the lamp due to the way in which the lamp electrodes have hitherto been mounted. For example, in a standard fluorescent lamp, the electrodes on each side project into the tube approximately a distance of 1.75" (43.75 mm), i.e. each filament is approximately $1\frac{3}{4}$" away from the lamp ends. For each tube, there is therefore, a length of $3\frac{1}{2}$" (87.5 mm) which is providing little or no illumination.

SUMMARY OF THE INVENTION

It is, therefore, a principal object of this invention to provide a low pressure arc discharge lamp which will be of a reduced length compared to prior art devices.

It is a further object to provide an arc discharge lamp which has an improved uniform illumination output along its entire length.

These objects are accomplished in one embodiment by traversely mounting the lamp electrodes within the ends of the tube and at a much smaller distance to each end wall, thereby greatly reducing that portion of the lamp which is not contributing to the overall illumination and permitting construction of a shorter length lamp.

DRAWINGS

DESCRIPTION

Figure 1:
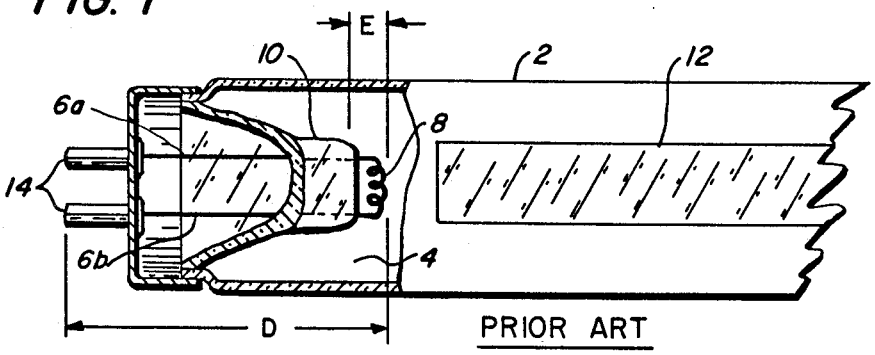
FIG. 1 is a partially cut away view of a prior art lamp showing a typical electrode mounting.

FIG. 1 shows a typical prior art fluorescent lamp electrode mounting construction. One end only is shown broken away. The lamp consists of an elongated envelope 2 having a phosphor layer formed on the inner surface and a quantity of mercury and an inert rare gas sealed within the envelope. Electrode 4 is sealed in the end of the tube. The electrode comprises a pair of lead wires *6a, 6b* and a tungsten coated filament 8 welded or mechanically clamped to the inner ends of wires *6a, 6b*. An electron emissive substance is coated on the filament. The wires are supported by stem mount 10. Aperture 12 is provided to direct illumination along a relatively narrow band as required in a photocopier scanning exposure mode. A distance D of 1.75" (43.75 mm) is measured from the filament to the projecting electrode terminals 14. Distance E, approximately $\frac{3}{4}$" (8.3 mm), is measured from the filament to the end of stem mount 10. Distance D minus distance E represents a section of the tube which is required because of the electrode mounting configuration but which does not contribute to the illumination output.

Figure 2:
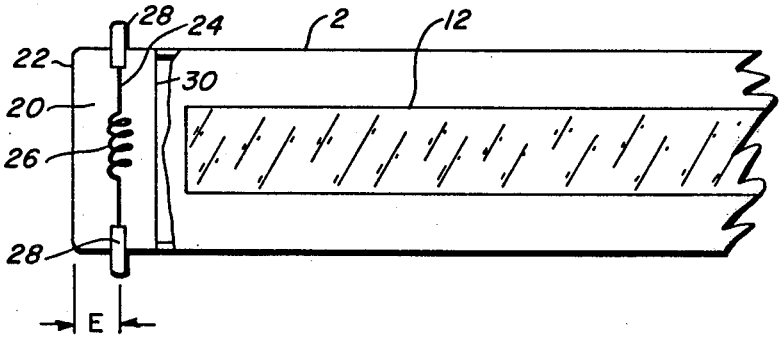
FIG. 2 is a partially cut away view of a lamp electrode mounting according to the present invention.

FIG. 2 shows a modified electrode mounting according to the present invention. In this arrangement, stem mount 10 of FIG. 1 has been replaced by a lamp tubing segment 20 having an end 2 sealed and flattened. Electrode 24 comprises only a filament 26 connected to pins 28 which are mounted perpendicular to the wall of envelope 2 and extend through the wall. The pins are separated from each other by 180° of the tube circumference. Segment 20 is sealed to the remainder of envelope 2 at surface 30 using standard glass-to-glass sealing techniques. Pins 28 are sealed at the envelope interface using state-of-the art techniques. As shown, the filament is now separated from end 22 by distance E, or $\frac{3}{8}$". The $1\frac{3}{8}$" (34.4 mm) additional space required by the FIG. 1 construction is not needed, resulting in a shorter lamp providing the same exposure level.

Figure 3:
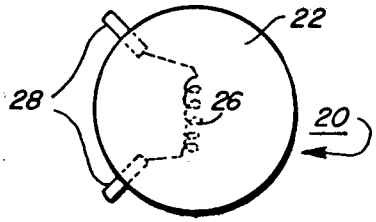
FIG. 3 is an end view of a second lamp electrode mounting according to the present invention.

The lamp pins may be separated by radial segments other than 180° and the pins need not be mounted perpendicular to the envelope end. FIG. 3 shows a second embodiment of the invention wherein pins 28 are separated by approximately a 90° segment of arc and the pins make an angular projection into the tube. Still other configurations are possible consistent with the invention. For example, although the two embodiments chosen have the filament wires and pins lying substantially within a plane perpendicular to the envelope axis, the tube pins may lie within two separate perpendicular planes with the filament lying in a third perpendicular plane.

The essential aspect of the invention is that the filaments be mounted as close as practicable to the tube ends; any terminal pin combination which achieves this end can be used. The specific pin location chosen will be a function of the subsequent lamp power connections for the particular system.

While the embodiments disclose a mounting arrangement which locates the filament to within $\frac{3}{8}$" of the tube end, it should be appreciated that this distance is the closest distance achievable with state-of-the art materials. It is possible that the filament may be moved even closer to the tube end if glass of even greater heat resistance is developed.

In either the FIG. 2 or FIG. 3 embodiment, the surfaces surrounding the electrode, i.e. the inner surfaces of segment 20, can be coated with a reflective material to increase efficiency. An additional advantage to the lamp construction according to the present invention is that since the electrode leads no longer project from the ends of the lamp, the lamp can be slidably mounted in a circular, grooved support. This permits easy removal of the tube and also allows the tube to be rotated to provide precise aligning of the tube aperture.

A shorter length of lamp which provides the same illumination along a specified surface area as does a larger tube length has obvious advantages in saving of construction costs and more importantly, space. For example, in a typical xerographic scanning system such as used in the Xerox 3100 copier, an apertured fluorescent lamp having a length of 22.5" would be required to expose a 14" wide document. By substituting a lamp constructed in accordance with the principles of this invention, the same radiometric results are obtainable with the lamp length reduced by $2\frac{3}{4}$" from 22.5 to $19\frac{3}{4}$". This allows a more compact light housing to be used.

Although the invention has been described in relation to a fluorescent lamp, it is useful in other low pressure arc discharge lamps such as sodium vapor lamps.

What is claimed is:

1. A low pressure gaseous discharge lamp comprising an elongated tubular glass envelope containing an ionizable medium therein; and a pair of filament electrodes sealed within the envelope at opposite ends thereof, each of said electrodes having a pair of electrical terminal connections projecting through said elongated envelope surface.

2. The lamp of claim 1 wherein the terminal connections for each electrode are on opposite sides of the envelope surface whereby the filament extends across the tube in a plane generally perpendicular to the tube axis.

3. The lamp of claim 1 wherein said terminal connections for each electrode project from sections of the envelope at locations not diametrically opposite.

4. A gaseous discharge lamp comprising an elongated tubular glass envelope containing an ionizable medium thereon, said envelope comprising first and second end sections sealed to a third middle segment; and an electrode sealed within each end section, each terminal electrode having a pair of electrical connections projecting through said elongated envelope surface.

5. The lamp of claims 1 or 4 wherein the interior surfaces of said end sections are coated with a reflective material.

6. The lamp of claim 4 wherein said lamp is a fluorescent lamp having its entire inner surface covered with a phosphor material.

7. The lamp of claim 6 wherein said lamp has a central portion of said phosphor layer removed to form a clear aperture.

* * * * *

UNITED STATES PATENT AND TRADEMARK OFFICE

CERTIFICATE OF CORRECTION

PATENT NO. : 4,317,066

DATED : February 23, 1982

INVENTOR(S) : Thomas J. Hammond, et al.

It is certified that error appears in the above-identified patent and that said Letters Patent are hereby corrected as shown below:

Col. 2, line 11, change "3/4" " to --3/8"--.

Col. 2, line 21, change "end 2" to --end 22--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*